US011259566B1

(12) United States Patent
Botton

(10) Patent No.: US 11,259,566 B1
(45) Date of Patent: Mar. 1, 2022

(54) FLUID-BASED ELECTRONIC CIGARETTE SYSTEM

(71) Applicant: ELEMENT ELIQUID, LLC, Hallandale Beach, FL (US)

(72) Inventor: David Botton, Hallandale Beach, FL (US)

( * ) Notice: Subject to any disclaimer, the term of this patent is extended or adjusted under 35 U.S.C. 154(b) by 0 days.

(21) Appl. No.: 17/400,049

(22) Filed: Aug. 11, 2021

(51) Int. Cl.

| | |
|---|---|
| ***A24F 40/30*** | (2020.01) |
| ***A24F 40/10*** | (2020.01) |
| ***A24F 40/48*** | (2020.01) |
| ***A24F 7/00*** | (2006.01) |
| ***A24F 40/42*** | (2020.01) |

(52) U.S. Cl.
CPC ..... *A24F 40/30* (2020.01); *A24F 7/00* (2013.01); *A24F 40/10* (2020.01); *A24F 40/42* (2020.01); *A24F 40/48* (2020.01)

(58) Field of Classification Search
None
See application file for complete search history.

(56) References Cited

U.S. PATENT DOCUMENTS

| | | | | |
|---|---|---|---|---|
| 2009/0293892 | A1* | 12/2009 | Williams | A24F 40/42 131/328 |
| 2020/0288788 | A1* | 9/2020 | Vora | A24F 40/40 |
| 2021/0052001 | A1* | 2/2021 | McCloy | A24F 40/44 |

* cited by examiner

*Primary Examiner* — James Harvey
(74) *Attorney, Agent, or Firm* — The Plus IP Firm; Derek Fahey

(57) ABSTRACT

A fluid-based electronic cigarette system, including a first electronic cigarette that including at least a first housing with a first interfacing surface. In addition, the first electronic cigarette includes a first reservoir and a first mouthpiece. Also, the system includes a second electronic cigarette, which contains at least a second housing. The second housing has a second interfacing surface, a second reservoir, and a second mouthpiece. In addition, an assembled configuration is formed when the first interfacing surface removably connects to the second interfacing surface. In the assembled configuration, a unitary mouthpiece formed by the first mouthpiece and the second mouthpiece.

20 Claims, 14 Drawing Sheets

FLUID-BASED ELECTRONIC CIGARETTE SYSTEM

CROSS-REFERENCE TO RELATED APPLICATIONS

Not applicable.

STATEMENT REGARDING FEDERALLY SPONSORED RESEARCH OR DEVELOPMENT

Not applicable.

INCORPORATION BY REFERENCE OF MATERIAL SUBMITTED ON A COMPACT DISC

Not applicable.

TECHNICAL FIELD

The present invention relates to the field of heated, vaporized, and combustible nicotine systems, and more specifically to the field of electronic cigarettes.

BACKGROUND

Users of electronic cigarettes must contend with choosing devices based on the internal fluid concentration, fluid flavoring, volume of the fluid, transporting electronic cigarettes, and using electronic cigarettes.

A single electronic cigarette, which is a typical use case in the prior art, contains design limitations that can restrict a user's flexibility and choices. For example, a single electronic cigarette has only one internal fluid reservoir. The fluid reservoir usually only has a single fluid, with a fixed nicotine concentration and flavoring. Furthermore, certain jurisdictions even regulate the volume of the reservoir, which can limit consumer choice and flexibility. The result is fewer options for the consumer based on the design of a traditional electronic cigarette.

If a user decides to use more than one electronic cigarette, the problem only magnifies. For example, transporting additional electronic cigarettes can be cumbersome. A user can store electronic cigarettes in a carrying case, but a case is typically bulky and can be heavy. Transporting multiple electronic cigarettes loosely, such as in a clothing pocket, can be unorganized and may lead a user to lose electronic cigarettes by accident.

Furthermore, beyond transportation, when an individual smokes more than one electronic cigarette simultaneously, then there are additional problems with the prior art. For example, smoking two electronic cigarettes concurrently can be extremely awkward, as the mouthpieces may be different shapes or the electronic cigarette housings may not properly align or fit symmetrically within the user's mouth. Combining mouthpieces that are different shapes or that form an uncomfortable shape results in user discomfort. In addition, because the housings of the different electronic cigarettes are separated, it may be difficult for the user to control each individual electronic cigarette within their mouth. A user smoking two electronic cigarettes also must balance each apparatus with their fingers and hands, which also is cumbersome. As a result, the smoking process is clunky, awkward, and uncomfortable.

Furthermore, there is a fluid flavoring problem with the prior art. An electronic cigarette contains one flavoring within its fluid reservoir. To adjust the flavoring or add flavoring, one must smoke an additional electronic cigarette. However, the same issues arise when trying to smoke the additional electronic cigarette, namely, the poor user experience due to the awkwardness and cumbersome nature of the prior art.

In addition, electronic cigarettes can be used for smoking cessation. However, due to the design limitations, the smoking cessation process can be frustrating. For example, weaning nicotine concentrations is one such smoking cessation tactic. However, the prior art teaches having to switch incrementally from a single electronic cigarette to a different electronic cigarette due to the problems with the single reservoir design. An electronic cigarette can only have one type of concentrated nicotine fluid; switching to a different concentration requires switching to an entirely different electronic cigarette.

Moreover, all the problems identified with the prior art of electronic cigarettes applies more broadly to devices of heated, vaporized, and combustible nicotine systems, even including traditional cigarettes and cigars. For example, a single traditional cigarette or cigar only has a certain flavoring profile. In addition, it is cumbersome to smoke more than one cigarette or cigar simultaneously for the same reasons outlined for electronic cigarettes. Also, smoking cigarettes or cigars for smoking cessation still requires switching to a different apparatus when stepping down nicotine concentrations when weaning off nicotine. Furthermore, heated, non-combustible nicotine products also can be bulky; the size of the apparatus makes it difficult to use more than one simultaneously, exacerbating the difficulty of trying to utilize different nicotine concentrations or flavor profiles at the same time.

As a result, there exists a need for improvements over the prior art and more particularly for a more efficient way of facilitating smoking more than one electronic cigarette in a comfortable, ergonomic, and assembled manner.

SUMMARY

A system for a fluid-based electronic cigarette system is disclosed. This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

In one embodiment, a fluid-based electronic cigarette system is disclosed. The system comprises a first electronic cigarette that includes at least a first housing with a first interfacing surface. In addition, the first electronic cigarette includes a first reservoir. Furthermore, the first electronic cigarette also includes a first mouthpiece. Also, the system includes a second electronic cigarette, which contains at least a second housing. The second housing has a second interfacing surface, a second reservoir, and a second mouthpiece. In addition, in an assembled configuration, the first interfacing surface is configured to removably connect to the second interfacing surface. In the assembled configuration, a unitary mouthpiece is formed by the first mouthpiece and the second mouthpiece.

Additional aspects of the disclosed embodiment will be set forth in part in the description which follows, and in part will be obvious from the description, or may be learned by practice of the disclosed embodiments. The aspects of the disclosed embodiments will be realized and attained by means of the elements and combinations particularly pointed out in the appended claims. It is to be understood that both the foregoing general description and the following detailed description are exemplary and explanatory only and are not restrictive of the disclosed embodiments, as claimed.

BRIEF DESCRIPTION OF THE DRAWINGS

The accompanying drawings, which are incorporated in and constitute part of this specification, illustrate embodiments of the invention and together with the description, explain the principles of the disclosed embodiments. The embodiments illustrated herein are presently preferred, it being understood, however, that the invention is not limited to the precise arrangements and instrumentalities shown, wherein.

DETAILED DESCRIPTION

Figure 1:
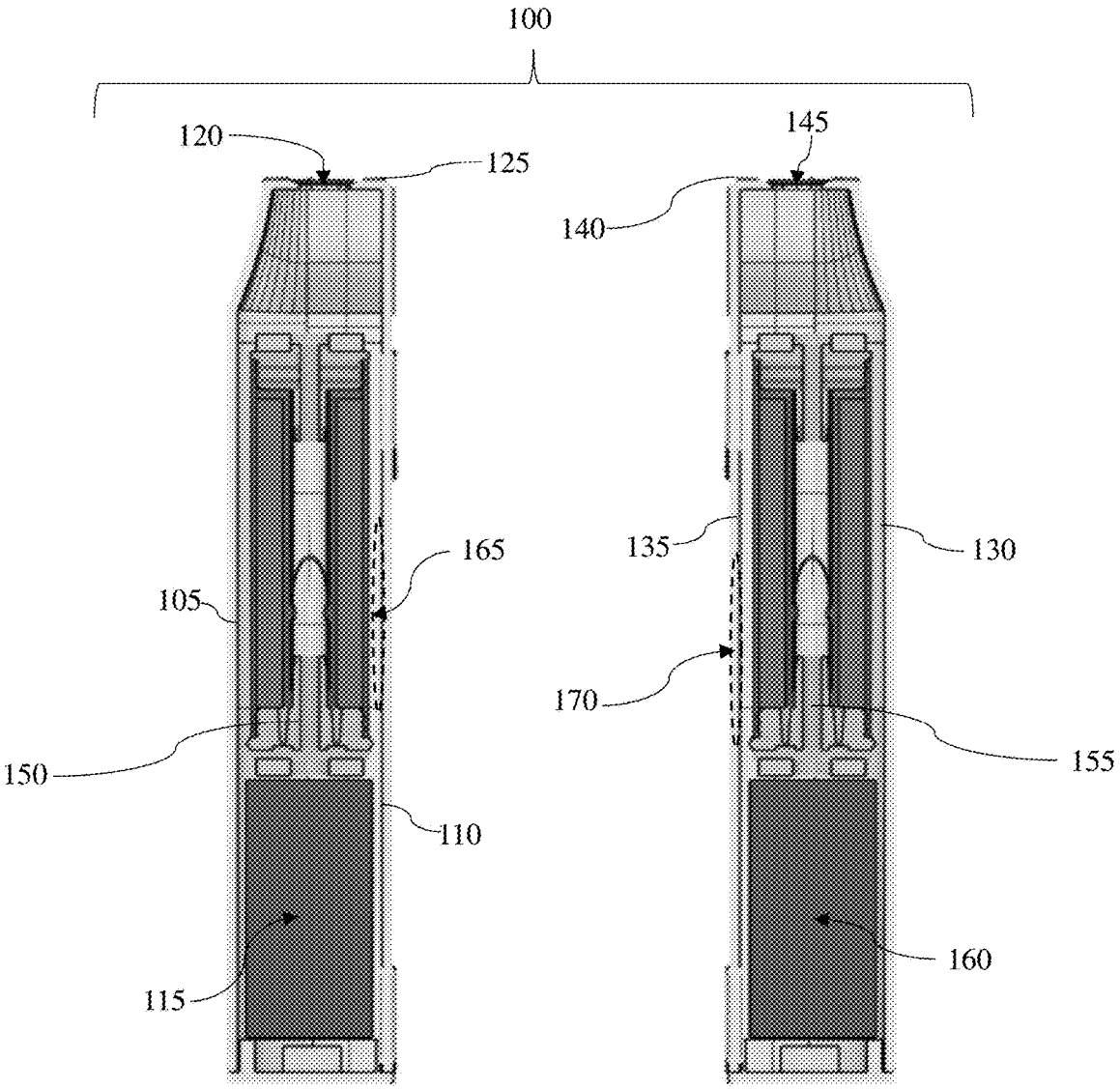
FIG. 1 is a side perspective partially exploded view of a fluid-based electronic cigarette system in a non-assembled configuration, according to an example embodiment.

The following detailed description refers to the accompanying drawings. Whenever possible, the same reference numbers are used in the drawings and the following description to refer to the same or similar elements. While disclosed embodiments may be described, modifications, adaptations, and other implementations are possible. For example, substitutions, additions, or modifications may be made to the elements illustrated in the drawings, and the methods described herein may be modified by substituting reordering or adding additional stages or components to the disclosed methods and devices. Accordingly, the following detailed description does not limit the disclosed embodiments. Instead, the proper scope of the disclosed embodiments is defined by the appended claims.

The disclosed embodiments improve upon the problems with the prior art by providing a fluid-based electronic cigarette system containing a first interfacing surface that can be configured to removably attach to a second interfacing surface to form an assembled configuration. The assembled configuration facilitates removably joining two separate electronic cigarettes to form a single unified apparatus. The system improves over the prior art because a first mouthpiece on the first electronic cigarette is adjacent to a second mouthpiece on the second electronic cigarette to form a single or unitary mouthpiece. Furthermore, the system improves over the prior art because each electronic cigarette within the system has a separate fluid reservoir. In addition, the system improves upon the prior art because a first fluid reservoir can have a disparate volume from a second fluid reservoir. An additional improvement over the prior art is that the multiple fluid reservoirs allow for disparate nicotine fluid flavorings and concentrations when the system is used in the assembled configuration. Furthermore, the assembled configuration facilitates transporting the device in a secure manner, which is another improvement upon the prior art. In addition, the system improves upon the prior art because in the non-assembled configuration, each individual electronic cigarette may be used individually. When a user then desires to join at least two electronic cigarettes, they then can utilize the assembled configuration to operate the system.

Referring now to the Figures, FIG. 1 is a side partially exploded perspective view of a fluid-based electronic cigarette system in a non-assembled configuration, according to an example embodiment. The fluid-based electronic cigarette system 100 includes a first electronic cigarette 150 comprising at least a first housing 105, a first reservoir 115, and a first mouthpiece 120, wherein the first housing has a first interfacing surface 110.

The interfacing surfaces are surfaces of the device that will face another similar device. At different locations of the device (as further explained below) and may be at different locations on the device.

The first mouthpiece is located at a first housing first end 125, in an example embodiment. In an additional embodiment, the first mouthpiece may removably connect with the first housing or the first separate housing. The first reservoir may be contained within the first housing, in an example embodiment. In an additional embodiment, the first reservoir is located in a first separate housing that can removably connect with the first housing, or in a separate embodiment, the first separate housing permanently connects to the first housing. The first interfacing surface is located along one side of the first housing, in an example embodiment.

The system 100 may contain at least one first magnet 165 at least proximate to the first interfacing surface. The term at least proximate to the interfacing surface may mean that the magnet may be disposed or embedded below the surface of the first interfacing surface, in an example embodiment. In an additional embodiment, the term at least proximate to the interfacing surface may mean that the at least one first magnet may be the flush with the first interfacing surface. Furthermore, in another embodiment, the term at least proximate to the interfacing surface may mean that the at least magnet may be raised above the surface of the first interfacing surface. The magnet may be covered by materials for aesthetic purposes.

In addition, the system includes a second electronic cigarette 155 containing at least a second housing 130, a second reservoir 160, and a second mouthpiece 145, wherein the second housing has a second interfacing surface 135. The second reservoir may be contained within the second housing in an example embodiment. In an additional embodiment, the second reservoir is located in a second separate housing that can removably connect with the second housing, or in a separate embodiment, the second separate housing permanently connects to the second housing. The second mouthpiece is located at a second housing first end 140, in an example embodiment. In an additional embodiment, the second mouthpiece may removably connect with the second housing or the first separate housing.

The second interfacing surface, in an example embodiment, is located along one side of the second housing. The system 100 may contain at least one second magnet 170 at least proximate to the second interfacing surface. The at least one second magnet may be deposited below the surface of the second interfacing surface, in an example embodiment. In an additional embodiment, the at least one second magnet may be the flush with the second interfacing surface. Furthermore, in an additional embodiment, the at least one second magnet may be raised above the surface of the second interfacing surface. In addition, the first interfacing surface and the second interfacing surface are each substantially planar such that the first interfacing surface and second interfacing surface have flat portions where the first interfacing surface and the second interfacing surface contact each other, in an example embodiment. In an additional embodiment, the first interfacing surface and the second interfacing surface are substantially non-planar such that each of the first interfacing surface and the second interfacing surface may include curved portions configured to contact each other.

The first mouthpiece and the second mouthpiece facilitate a user to inhale, and smoke vaporized or atomized fluid. Within the first mouthpiece and the second mouthpiece, there is a channel that allows the vaporized or atomized fluid to escape from the first housing and the second housing. In the non-assembled configuration as depicted in FIG. 1, the user can separately control and smoke the first electronic cigarette and the second electronic cigarette.

The first housing, the second housing, the first reservoir, the second reservoir, the first mouthpiece, and the second mouthpiece may be comprised of material such as carbon steel, stainless steel, aluminum, titanium, other metals or alloys, composites, ceramics, polymeric materials such as polycarbonates, such as Acrylonitrile butadiene styrene (ABS plastic), Lexan™, and Makrolon™. The first housing, the second housing, the first reservoir, the second reservoir, the first mouthpiece, and the second mouthpiece may be formed from a single piece or from several individual pieces joined or coupled together. The components of the housing may be manufactured from a variety of different processes including an extrusion process, a mold, welding, shearing, punching welding, folding etc.

The first housing, the second housing, the first reservoir, the second reservoir, the first mouthpiece, and the second mouthpiece may be manufactured from a variety of different processes including an extrusion process, a mold, welding, shearing, punching welding, folding etc. However, other types of processes may also be used and are within the spirit and scope of the present invention.

The first electronic cigarette 150 and the second electronic cigarette 155 may be powered by a power source, which may include a standard dry cell battery commonly used in low-drain portable electronic devices (i.e., AAA batteries, AA batteries, etc.). Other types of batteries may be used including rechargeable batteries, aluminum air batteries, lithium batteries, paper batteries, lithium-ion polymer batteries, lithium iron phosphate batteries, magnesium iron batteries etc. Additionally, other types of battery applications may be used and are within the spirit and scope of the present invention. For example, a battery stripper pack may also be used. Additionally, other types of power sources may also be used and are within the spirit and scope of the present invention.

Figure 2:
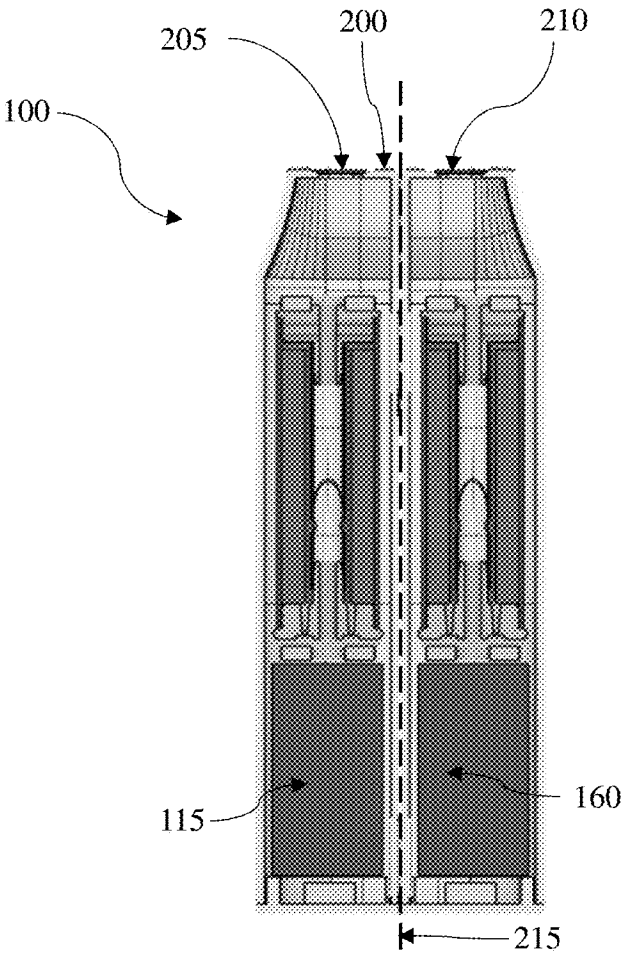
FIG. 2 is a side perspective view of a fluid-based electronic cigarette system in an assembled configuration, according to an example embodiment.

Referring to FIG. 2, disclosed is a side perspective view of a fluid-based electronic cigarette system in an assembled configuration, according to an example embodiment. Furthermore, the assembled configuration is formed when the first interfacing surface removably connects to the second interfacing surface. In the assembled configuration, a first mouthpiece 205 is adjacent to a second mouthpiece 210. In addition, in the assembled configuration, a unitary mouthpiece 200 is formed when at least one of (a) the first mouthpiece is at least adjacent to the second mouthpiece, and (b) the first mouthpiece and second mouthpiece are configured such that the first mouthpiece and second mouthpiece can be simultaneously inserted into a user's mouth, according to an example embodiment. However, it is understood that other embodiments for a unitary mouthpiece we be used and are within the spirit and scope of the present invention.

The fluid-based electronic cigarette system 100 is symmetrical about a line of symmetry 215 defined by a midpoint between the first interfacing surface and the second interfacing surface. Within the first housing, a first reservoir 115 is contained within. Additionally, in the second housing, a second reservoir 160 is contained within. In addition, the at least one first magnet 165 magnetically mates with the at least one second magnet 170 to form the assembled configuration.

In one embodiment, the assembled configuration facilitates secure transport of the electronic cigarette system because each individual electronic cigarette is removably attached, rather than be loosely transported or transported in a bulky carrying container.

In an additional embodiment, a user may removably attach a first electronic cigarette partially to a second electronic cigarette. This configuration can facilitate at least two individuals using the system concurrently. In this example embodiment, the first mouthpiece would not be adjacent to the second mouthpiece, but rather adjacent to the opposite end of the second housing first end.

Referring now to FIGS. 1-2, in one embodiment, the first electronic cigarette comprises a first fluid disparate from a second fluid in the second electronic cigarette. This embodiment allows an individual to customize their nicotine content. With customized nicotine contents, a user can tailor their nicotine intake in a methodical and deliberate manner, such as for smoking cessation. The mixing and matching ability of this embodiment allows for a myriad of nicotine content possibilities. In this embodiment, the individual can seamlessly operate the system with a customized nicotine concentration. In an additional embodiment, the first e-fluid and the second e-fluid contain the same nicotine content, allowing for at least twice the concentration of nicotine content in the assembled configuration.

In an additional embodiment, the first electronic cigarette 150 comprises a first e-fluid having a first flavor disparate from a second e-fluid in the second electronic cigarette 155 having a second flavor. This embodiment, in the assembled configuration, allows for the user to create a combination of flavors by combining electronic cigarettes which contain disparate flavored e-fluids. This allows the user to customize what flavor profile they desire, with great flexibility to mix and match in a convenient manner. In this embodiment, the individual can seamlessly operate the system with a customized flavor combination. In an additional embodiment the first e-fluid and the second e-fluid contain the same flavor, allowing for at least twice the volume of flavoring in the assembled configuration.

Furthermore, an additional embodiment discloses that the first electronic cigarette comprises a first volume disparate from a second volume of the second electronic cigarette. In other words, the first volume is contained separately from the second volume. In an additional embodiment, the first volume and the second volume have a maximum volume of 2 milliliters.

In one embodiment, the first housing and the second housing are a geometric shape that is substantially rectangular such that first housing and the second housing include a cross-section that is defined by a rectangle. The first housing and second housing may be a rectangular prism. In an additional embodiment, the shape of the first housing and the second housing is substantially triangular such that the cross-section of the first housing and the second housing defines a triangle. In an additional embodiment, the system can be expanded in the assembled configuration continuously by removably attaching additional electronic cigarettes to the first housing or to the second housing.

Figure 3A:
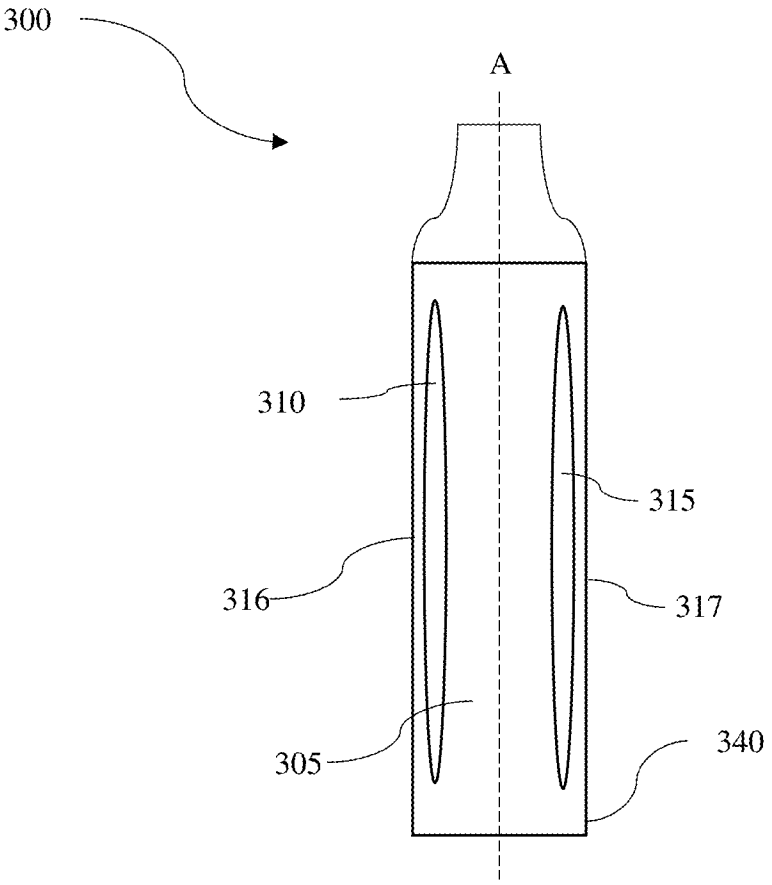
FIG. 3A is a diagram of a side perspective view of a fluid-based electronic cigarette, according to an example embodiment.

Referring to FIG. 3A, disclosed is a diagram of a side perspective view of a fluid-based electronic cigarette 300, featuring a housing 340 having an interfacing surface 305 on an exterior of the housing, according to an example embodiment. In addition, the fluid-based electronic cigarette has a magnet 310 at least proximate to the interfacing surface, according to an exemplary embodiment. In an additional embodiment, the fluid-based electronic cigarette has a second magnet 315. In an additional embodiment, the magnet is at least proximate to the interfacing surface and to a first side edge 316 of the interfacing surface and wherein the magnet has a magnet pole proximate to the exterior of the interfacing surface. In addition, a second magnet is at least proximate to the interfacing surface and to a second side edge 317 of the interfacing surface and the second magnet has a second magnet pole proximate to the exterior of the interfacing surface. Furthermore, the magnet pole is different than the second magnetic pole, according to an example embodiment. In other embodiments the magnets may not be proximate to the side edge of the interfacing surface. The magnets may be on the side edge, close to the side edge, away from the side edge as long as the magnetic fields do not interfere with the mating of each of the magnets with other magnets of companion magnetic cigarettes. In other words, the position of the magnets on the left side of the longitudinal midline of the interfacing surface and on the right side of the longitudinal midline of the interfacing surface may only be a distance away from each other so when the device mates with another device the magnets magnetically mate with the other. Stated differently, magnets are a certain distance apart from each other. In other embodiments, as explained the below the magnets may be positioned on either side of the longitudinal midline of interfacing surface. In other embodiments, the device may have one magnet positioned so that one pole is one side of the longitudinal midline, and a second pole is on a second side of the midline.

As shown in these embodiments, at least one magnet is positioned on either side of longitudinal midline of the interfacing surface the longitudinal midline (line A in FIG. 3A and FIG. 3B) of the device. Each of the magnets on a first side of the longitudinal midline are configured such that the magnet on the first side's pole positioned closer to the exterior or the interfacing surface is opposite to a pole on the opposing side, or second side of the longitudinal midline positioned closer to the exterior or the interfacing surface. This arrangement allows the device to magnetically mate with a similar device having magnets arranged in a similar manner. In other embodiments, a single magnet may be used, where a first pole is on a first side of the longitudinal midline and as second pole is on a second side of the longitudinal midline so that device may magnetically mate with a similar device having a magnet arranged along the longitudinal midline in a similar manner. For example, FIG. 3B illustrates that a single magnet 321 may be arranged such that its's first pole 322 and second pole 323 are positioned spaced apart on both sides of the longitudinal midline (line A).

Figure 3B:
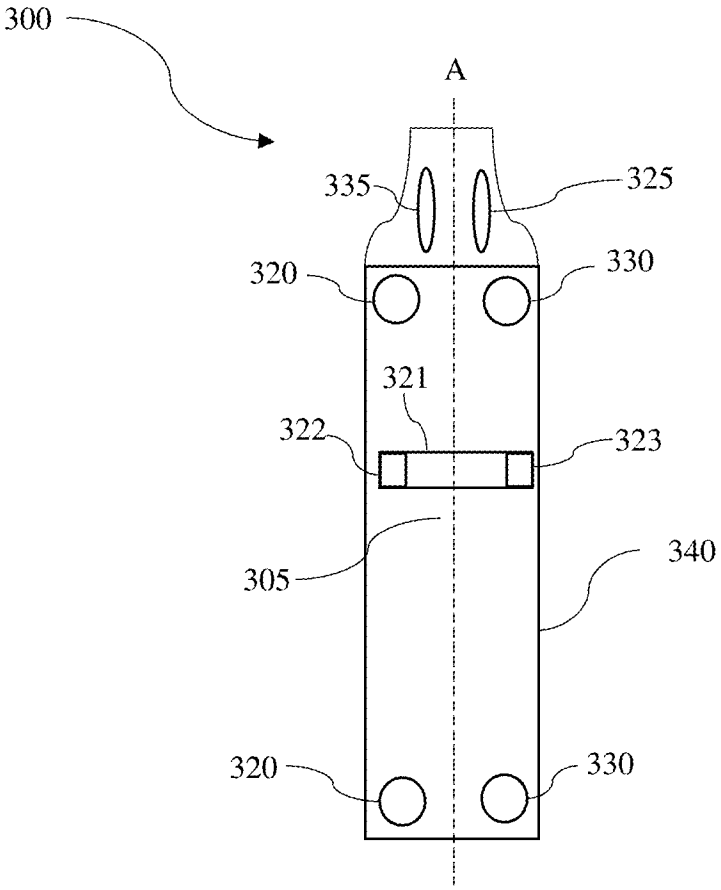
FIG. 3B is a diagram of a side perspective view of a fluid-based electronic cigarette, with alternate magnet placements, according to an example embodiment.

Referring to FIG. 3B, disclosed is a diagram of a side perspective view of a fluid-based electronic cigarette 300, featuring a housing 340 having an interfacing surface 305 on an exterior of the housing, according to an example embodiment. In addition, the fluid-based electronic cigarette has a first plurality of magnets 320 at least proximate to the interfacing surface, according to an exemplary embodiment. In an additional embodiment, the fluid-based electronic cigarette has a second plurality of magnets 330. In an additional embodiment, the first plurality of magnets is at least proximate to the interfacing surface and to a first side edge of the interfacing surface and wherein the first plurality of magnets has a magnet pole proximate to the exterior of the interfacing surface. In other embodiments, the location of the magnets may be inward from the edge of the interfacing surface, but far enough away from the other man gets so that the magnetic poles do not affect each other. In addition, the second plurality of magnets is at least proximate to the interfacing surface and to a second side edge of the interfacing surface and the second plurality of magnets has a second magnet pole proximate to the exterior of the interfacing surface. Similarly, in other embodiments, the location of the magnets may be inward from the edge of the interfacing surface, but far enough away from the other magnets so that the magnetic poles do not affect each other. Furthermore, the magnet pole is different than the second magnetic pole, according to an example embodiment. As mentioned above, in one embodiment, when a single magnet is used, the magnetic poles of magnet 321 does not affect each other in that when fluid-based electronic cigarette comes in to close proximity and the mouthpieces are aligned the magnets mate with each other and the magnetic poles do not interfere with each other.

In an additional embodiment, the fluid-based electronic cigarette has a first mouthpiece magnet 335 contained within the first mouthpiece. Furthermore, a second mouthpiece magnet 325 is contained within the first mouthpiece. The first mouthpiece magnet has a first magnetic pole, and the second mouthpiece magnet has a second magnetic pole. The first magnetic pole is proximate to the exterior of a first side of the first mouthpiece, and the second magnetic pole is proximate to the exterior of a second side of the first magnetic pole. The first magnetic pole is disparate from the second magnetic pole. This allows easier manufacturing because first magnetic pole of one device may be mated with the second magnetic pole of a second device.

Figure 4:
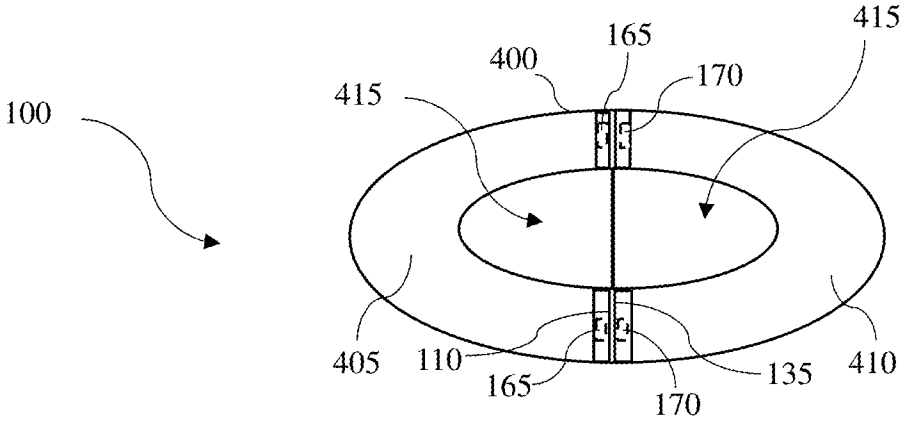
FIG. 4. is a top view of a fluid-based electronic cigarette system in an assembled configuration with a first mouthpiece and a second mouthpiece forming a unitary or single mouthpiece, according to an example embodiment.

Referring to FIG. 4, disclosed is a top view of a fluid-based electronic cigarette system 100 in an assembled configuration with a first mouthpiece 405 and a second mouthpiece 410 forming a unitary mouthpiece 400, according to an example embodiment. In one embodiment, the unitary mouthpiece has a transverse cross-section that is ovular. In an additional embodiment, the unitary mouthpiece may be rectangular, triangular, elliptical, or circular. In addition, in the assembled configuration, there is a void 415 within the unitary mouthpiece which defines the channel from which the vaporized or atomized fluid to escape from the first housing and the second housing. The unitary mouthpiece allows a user to operate and comfortably smoke from at least two electronic cigarettes concurrently when the system is in the assembled configuration. In addition, according to an example embodiment, the first mouthpiece and each mouthpiece each have a transverse cross section, and wherein each transverse cross section has a first side that is asymmetrical to second side.

In one embodiment, the at least one first magnet 165 is enclosed or embedded within the first interfacing surface 110 under a covering or casing to form a flat surface. In an additional embodiment, the at least one first magnet protrudes from the first interfacing surface under a raised covering or casing. In one embodiment, the at least one second magnet 170 is enclosed or embedded within the second interfacing surface 135 under a covering or casing to form a flat surface. In an additional embodiment, the at least one second magnet protrudes from the second interfacing surface under a raised covering or casing. In an additional embodiment, the first interfacing surface contains at least four magnets, and the second interfacing surface contains at least four magnets. A different example embodiment discloses the first interfacing surface with two magnets with disparate magnetic poles and the second interfacing surface with two magnets with disparate magnetic poles.

Figure 5:
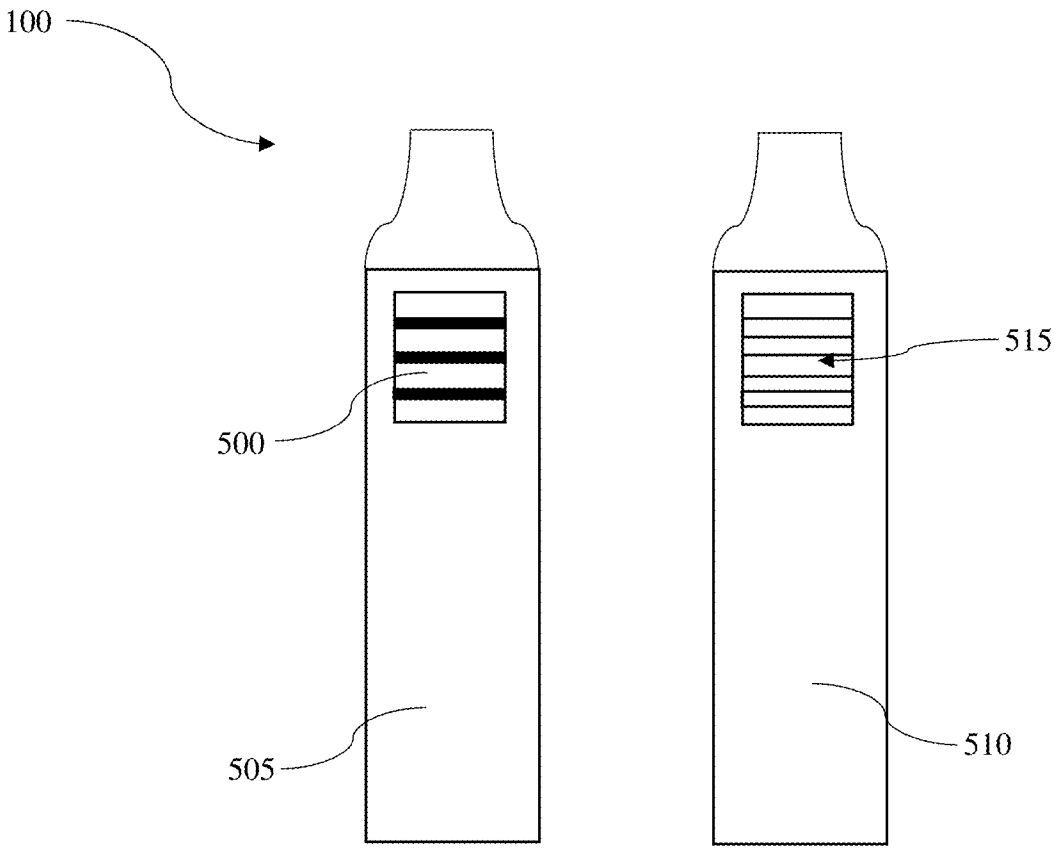
FIG. 5 is a diagram of a side perspective view of a fluid-based electronic cigarette system in a non-assembled configuration, featuring a first interfacing surface with a male track configured to removably mate with a female track on a second interfacing surface, according to an example embodiment.

Referring to FIG. 5, disclosed is a diagram of a side perspective view of a fluid-based electronic cigarette system in a non-assembled configuration, featuring a first interfacing surface with a male track configured to removably mate with a female track on a second interfacing surface, according to an example embodiment. In one embodiment of the fluid-based electronic cigarette system 100, the first interfacing surface 505 comprises a male track 500 configured to removably mate with a female track 515 on the second interfacing surface 510. In another example embodiment, the male track contains an extrusion or protrusion configured to engage with the female track. In an additional embodiment, the male track contains a fastener for mating with the female track. The faster may include a suction cup, hooks, bolt, set crews, opening configured to attached to protruding element, socket screws u-bolts, twine, etc. However, other types of fasteners may also be used and are within the spirit and scope of the present invention. The female track contains a rail with a lip along the edge for catching the male track in the assembled configuration, according to an example embodiment. In another embodiment, the female track has a slot which is configurated to engage with the male track to form the assembled configuration. In an additional embodiment, the female track is a void configured to engage with at least one protrusion from the male track to form the assembled configuration.

Figure 6B:
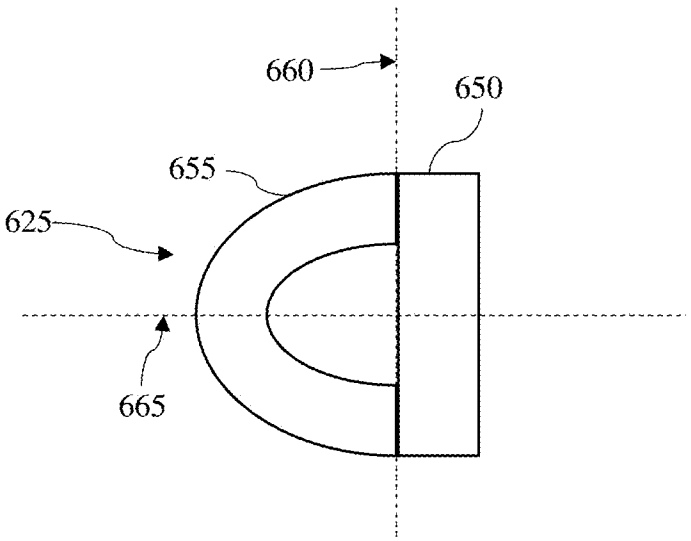
FIG. 6B is a top perspective view of a fluid-based electronic cigarette with an asymmetrical first mouthpiece first end adjacent to a first mouthpiece second end, according to an example embodiment.
Figure 6A:
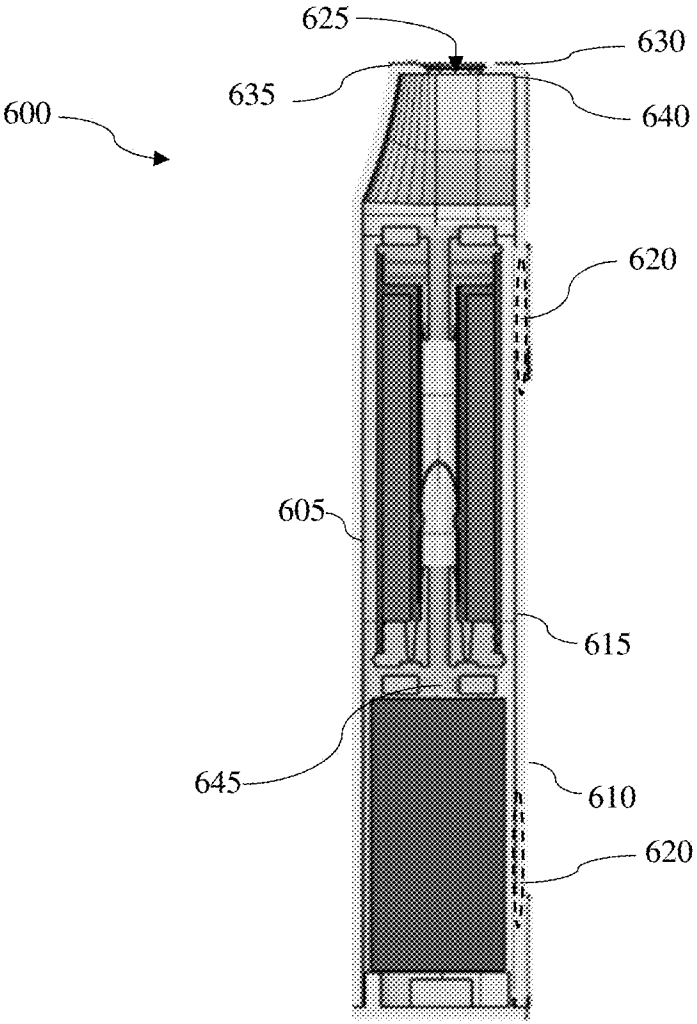
FIG. 6A is a side perspective view of a fluid-based electronic cigarette with an asymmetrical housing, according to an example embodiment.

Referring to FIG. 6A, disclosed is a side perspective view of a fluid-based electronic cigarette with an asymmetrical housing, according to an example embodiment. According to an example embodiment, the fluid-based electronic cigarette includes a housing having an interfacing surface on an exterior of the housing and a magnet at least proximate to the interfacing surface.

In one embodiment, the fluid-based electronic cigarette 600 includes a first housing 645 having a first housing first side 605 and a first housing second side 610. In addition, the first housing second side has a first interfacing surface 615, and the first interfacing surface is substantially planar. Furthermore, at least one first magnet 620 is in attachment with the first interfacing surface. Also, the first housing first side is asymmetrical to the first housing second side. Moreover, the fluid-based electronic cigarette includes first mouthpiece 625 at a first housing first end 640. The first mouthpiece has a first mouthpiece first side 635 asymmetrical to a first mouthpiece second side 630. In addition, the first mouthpiece second side is adjacent to the first housing second side, the first mouthpiece second side is adjacent to the first housing second side, and the first mouthpiece second side is substantially planar, according to an example embodiment.

The first housing and the first mouthpiece may be comprised of material such as carbon steel, stainless steel, aluminum, titanium, other metals or alloys, composites, ceramics, polymeric materials such as polycarbonates, such as Acrylonitrile butadiene styrene (ABS plastic), Lexan™, and Makrolon™. The first housing and second housing may be used to store certain components of an electric cigarette, such as the atomizer, the reservoir, the battery, electrical components, e-liquid. The first housing and second housing may also be used as a dummy cartridge for the sole purpose of attaching the first housing to the second housing. The first housing and the first mouthpiece may be formed from a single piece or from several individual pieces joined or coupled together. The components of the housing may be manufactured from a variety of different processes including an extrusion process, a mold, welding, shearing, punching welding, folding etc.

The first housing and the first mouthpiece may be manufactured from a variety of different processes including an extrusion process, a mold, welding, shearing, punching welding, folding etc. However, other types of processes may also be used and are within the spirit and scope of the present invention.

The at least one first magnet may be a permanent magnet, temporary magnet, or electromagnet. Furthermore, the at least one first magnet may be comprised of ferromagnetic materials, including iron, cobalt, nickel, neodymium, and samarium.

Referring to FIG. 6B, disclosed is a top perspective view of a fluid-based electronic cigarette with an asymmetrical first mouthpiece first side 655 adjacent to a first mouthpiece second side 650, which comprise a first mouthpiece 625, according to an example embodiment. The first mouthpiece second side is substantially planar, in an example embodiment; in an additional embodiment, the first mouthpiece second side is substantially non-planar. Also, the first mouthpiece is only symmetrical along a line of symmetry 665 in one embodiment. Along a line of symmetry 660 the first mouthpiece is asymmetrical, with an asymmetrical first mouthpiece first side and first mouthpiece second side.

Figure 7:
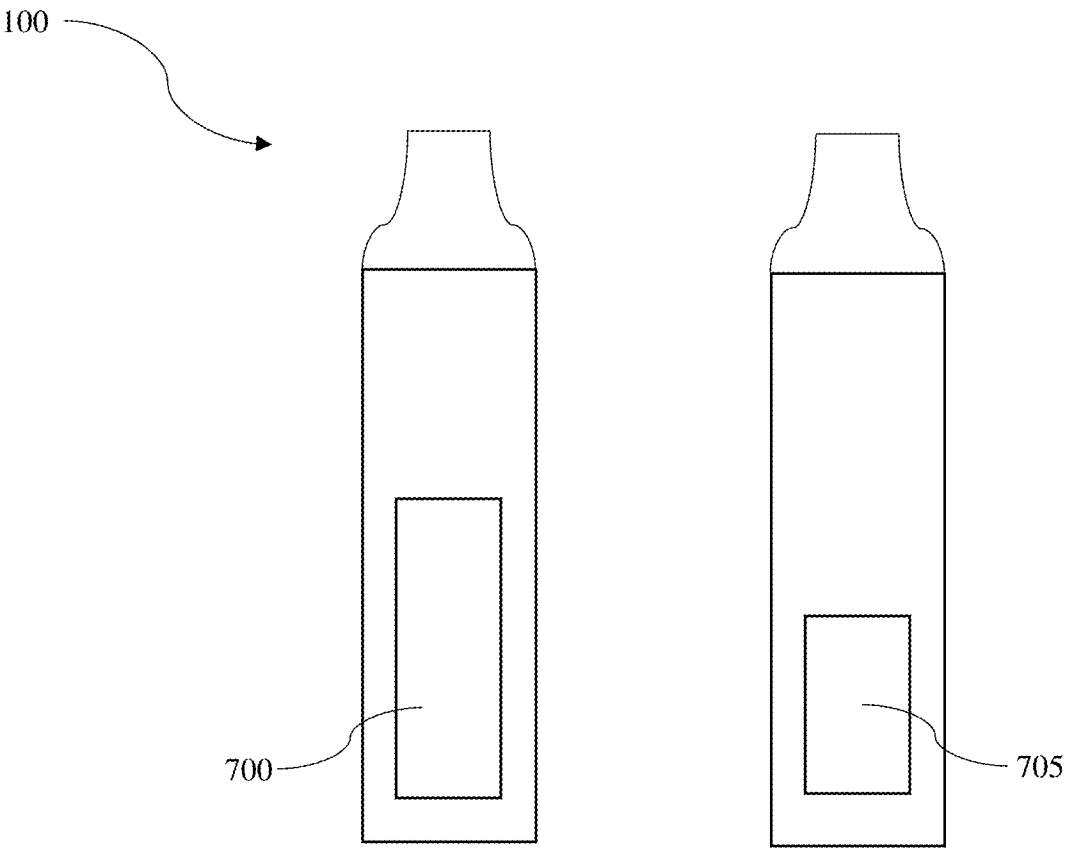
FIG. 7 is a diagram of a side perspective view of a fluid-based electronic cigarette system in a non-assembled configuration, featuring a first reservoir with a first volume disparate from a second volume contained within a second reservoir.

Referring to FIG. 7, disclosed is a diagram of a side perspective view of a fluid-based electronic cigarette system in a non-assembled configuration, featuring a first reservoir with a first volume that is unequal to a second volume contained within a second reservoir, according to an example embodiment. In one embodiment, the fluid-based electronic cigarette system 100 includes a first reservoir 700 comprising a first volume disparate than a second volume of the second reservoir 705. In an example embodiment, each reservoir having a disparate volume facilitates an individual mixing and matching electronic cigarettes with disparate fluid reservoir capacities. An example embodiment would be having a first reservoir and a second reservoir with disparate volumes of nicotine fluids to form a combined nicotine concentration or a combined flavoring concentration.

Figure 8A:
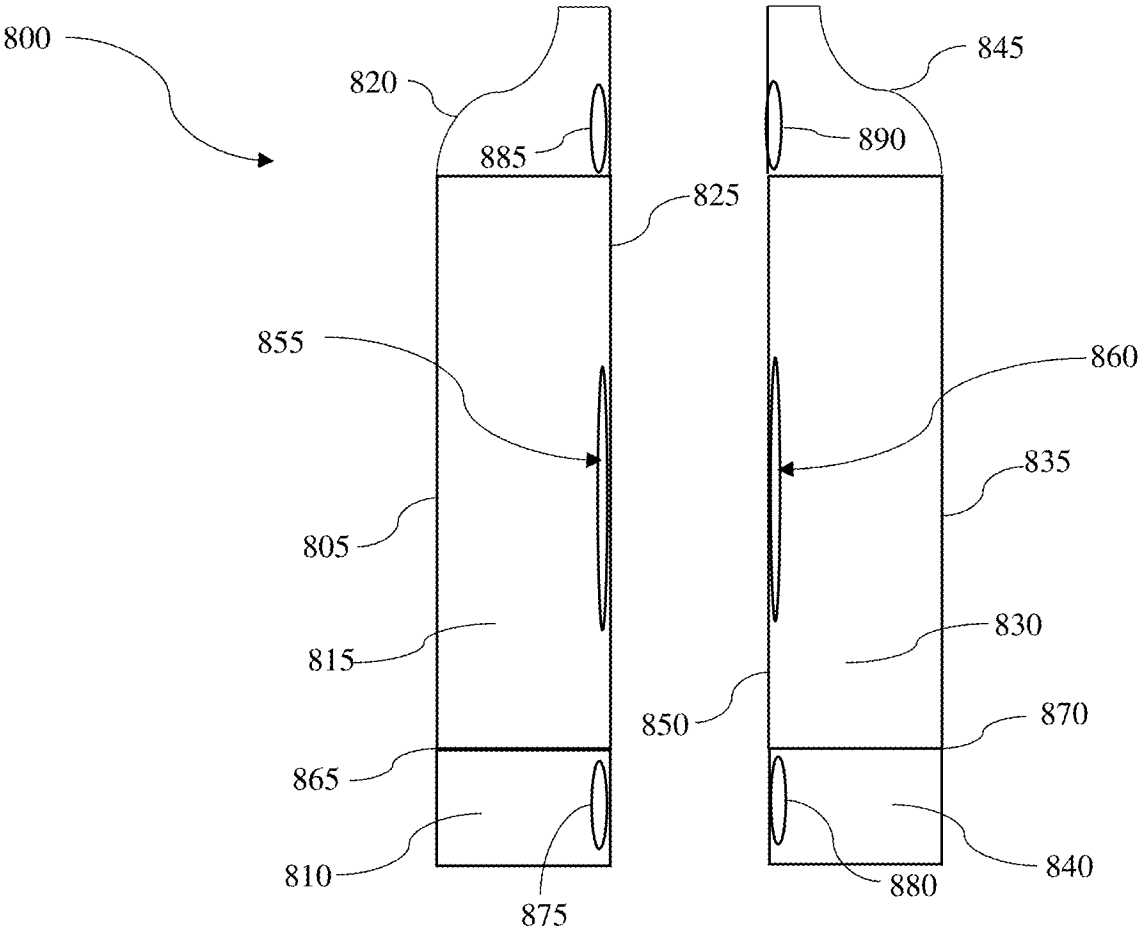
FIG. 8A is a diagram of a side perspective view of a fluid based electronic cigarette system in a non-assembled configuration, with two electronic cigarettes, according to an example embodiment.

Referring to FIG. 8A, disclosed is a diagram of a side perspective view of a fluid based electronic cigarette system 800 in a non-assembled configuration, according to an example embodiment. The system comprises a first cigarette 805 and a second cigarette 830. Furthermore, the first cigarette has a first housing 815 and a first magnet 855 at least proximate to a first surface 825 of the first housing. In addition, the second cigarette has a second housing 835 and a second magnet 860 at least proximate to a second surface 850 of the second housing. In one embodiment, the first housing defines a first volume disparate from a second volume of the second housing.

Furthermore, the first electronic cigarette contains a first pod housing 810. The first pod housing can contain a battery pack in one example embodiment. In an additional embodiment, the first pod housing contains a first fluid reservoir. Additionally, according to a different example embodiment, the first pod housing contains a first pod magnet 875 for connecting with an additional electronic cigarette, such as the second cigarette. The first pod housing attaches to the first housing via a fastener 865. The fastener may be a friction grip fastener, magnetic attacher, mate via a track system, or via a system of snaps.

The first cigarette 805 also contains a first mouthpiece 820. In one embodiment, the first mouthpiece contains a first mouthpiece magnet 890 for magnetically removably connecting with an additional electronic cigarette, such as the second cigarette 830.

In addition, the second electronic cigarette contains a second pod housing 840. The second pod housing can contain a battery pack in one example embodiment. In an additional embodiment, the second pod housing contains a first fluid reservoir. Additionally, according to a different example embodiment, the second pod housing contains a second pod magnet 880 for magnetically connecting with the first electronic cigarette.

The second cigarette also contains a second mouthpiece 845. In one embodiment, the second mouthpiece contains a second mouthpiece magnet 885 for magnetically removably connecting with an additional electronic cigarette, such as the first cigarette.

Figure 8B:
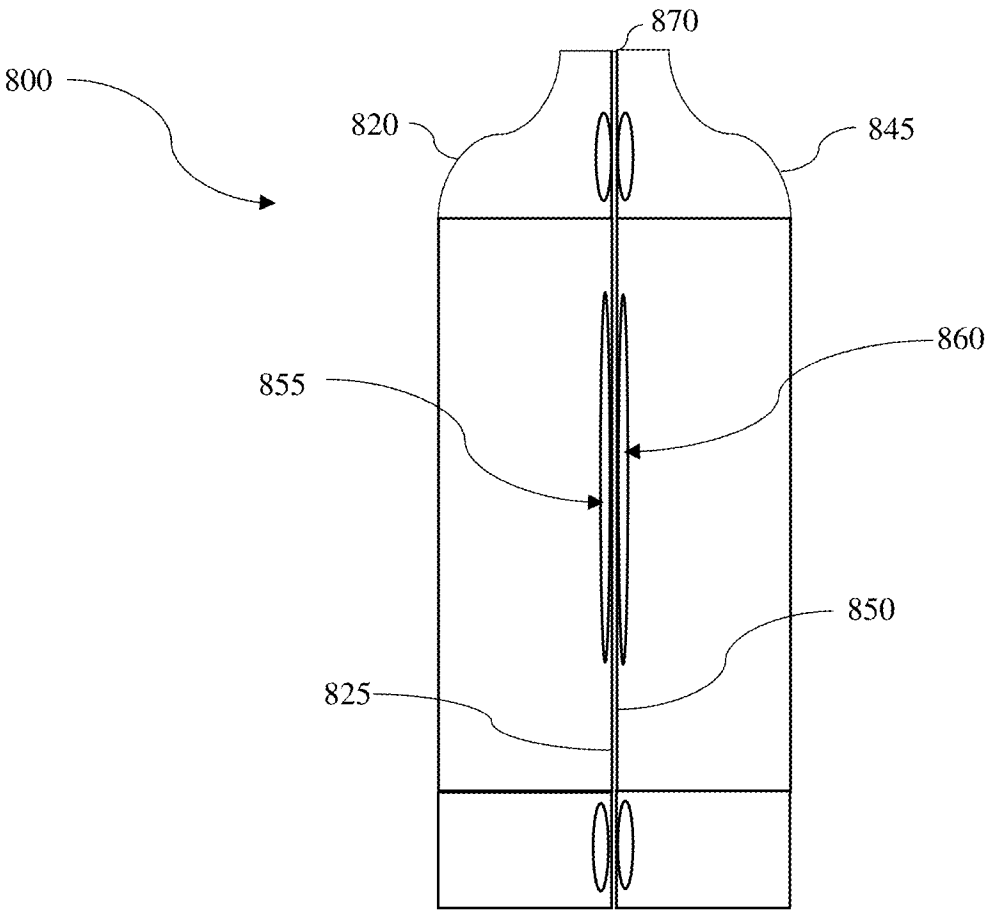
FIG. 8B is a diagram of a side perspective view of a fluid based electronic cigarette system in an assembled configuration, according to an example embodiment.

Referring to FIG. 8B, disclosed is a diagram of a side perspective view of a fluid based electronic cigarette system 800 in an assembled configuration, according to an example embodiment. The fully assembled configuration is formed when the second magnet 860 magnetically mates with the first magnet 855 such that the first surface 825 is at least close to the second surface 850. In certain embodiments the first surface may contact the second surface. In addition, a unitary mouthpiece 870 is formed in the fully assembled configuration when at least one of (a) the first mouthpiece 820 is at least adjacent to a second mouthpiece 845, and (b) the first mouthpiece and second mouthpiece are configured such that the first mouthpiece and second mouthpiece can be simultaneously inserted into a user's mouth.

Figure 9:
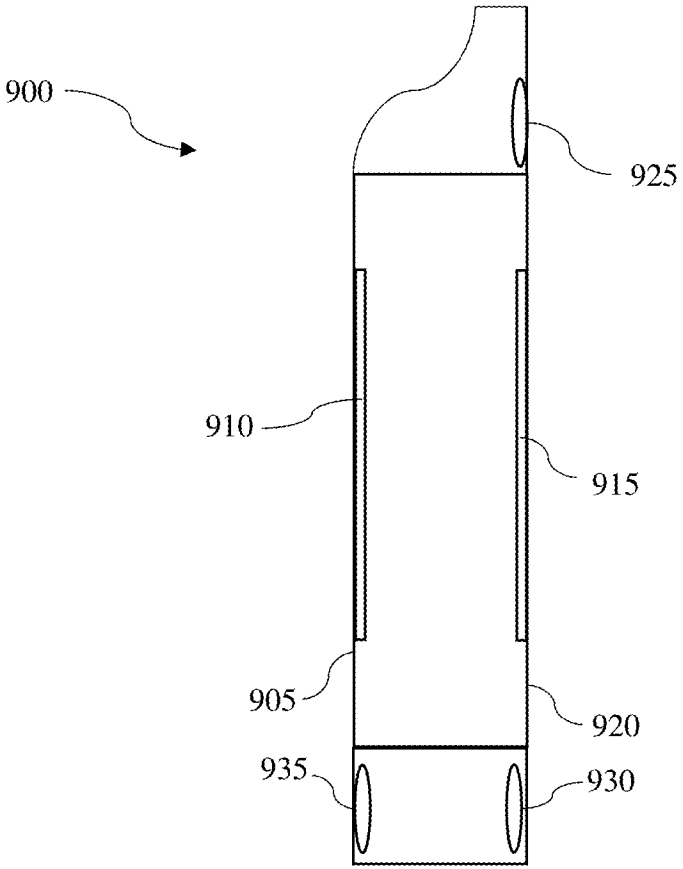
FIG. 9 is a diagram of a side perspective view of a fluid based electronic cigarette system in a non-assembled configuration, with a plurality of interfacing surfaces, according to an example embodiment.

Referring to FIG. 9, disclosed is a diagram of a side perspective view of a fluid based electronic cigarette system 900 in a non-assembled configuration, according to an example embodiment. The system contains a first interfacing surface 905 and a second interfacing surface 920. The first interfacing surface contains a first magnet 910 and the second interfacing surface contains a second magnet 915. The first magnet may be below, flush with, or raised above the first interfacing surface, according to example embodiments. The second magnet may be below, flush with, or raised above the second interfacing surface, according to example embodiments. The first magnet contained within the first interfacing surface and second magnet contained within the second interfacing surface facilitates the attachment of a third electronic cigarette to the system.

In one embodiment, the first magnet is at least proximate to the first interfacing surface and to a first side edge of the first interfacing surface and wherein the magnet has a magnet pole proximate to the exterior of the first interfacing surface. In addition, a second magnet is at least proximate to the first interfacing surface and to a second side edge of the first interfacing surface and wherein the second magnet has a second magnet pole proximate to the exterior of the first interfacing surface. Also, the magnet pole is different than the second magnetic pole. Furthermore, the second interfacing surface contains a third magnet is at least proximate to the second interfacing surface and to a first side edge of the second interfacing surface and wherein the third magnet has a third magnet pole proximate to the exterior of the second interfacing surface. In addition, a fourth magnet is contained within the second interfacing surface and is at least proximate to the interfacing surface and to a second side edge of the second interfacing surface and wherein the fourth magnet has a fourth magnet pole proximate to the exterior of the second interfacing surface, The system also contains a first pod magnet 935 and a second pod magnet 930 for magnetically attaching to other pods or electronic cigarettes, according to an example embodiment. The system also contains a first mouthpiece magnet 925 within the electronic cigarette mouthpiece, which can be configured for magnetically attaching to other mouthpieces or electronic cigarettes.

Figure 10A:
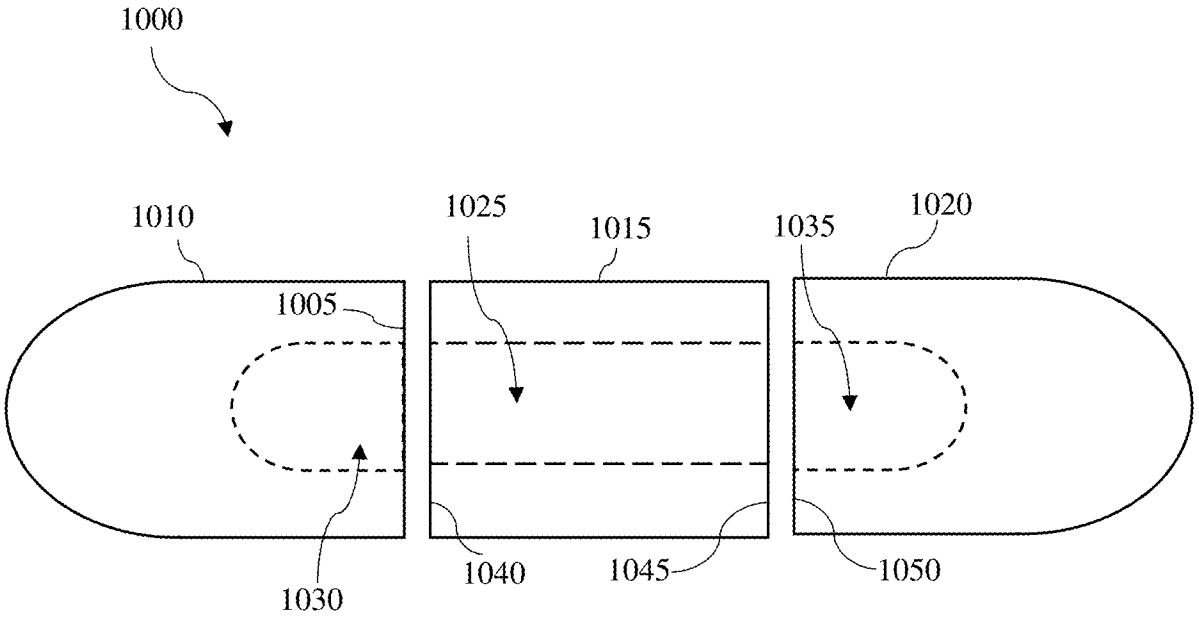
FIG. 10A is a diagram of a top perspective view of a fluid-based electronic cigarette system in an assembled configuration, according to an example embodiment.

Referring now to FIG. 10A, disclosed is a diagram of a top perspective view of a fluid-based electronic cigarette system 1000 in an assembled configuration, according to an example embodiment. The system contains a first mouthpiece 1010, a second mouthpiece 1015, and a third mouthpiece 1020. Within the first mouthpiece, there is a channel 1030 to allow vaporized or atomized fluid to escape from a first electronic cigarette. The first mouthpiece is symmetrical only about one line of symmetry, according to an example embodiment. Within the second mouthpiece, there is a channel 1025 to allow vaporized or atomized fluid to escape from a second electronic cigarette. According to an example embodiment, the second mouthpiece is symmetrical about two lines of symmetry and has a substantially rectangular geometric shape. Within the third mouthpiece, there is a channel 1035 to allow vaporized or atomized fluid to escape from a third electronic cigarette. The third mouthpiece is symmetrical only about one line of symmetry, according to an example embodiment.

The first electronic cigarette is in attachment with the second electronic cigarette due to the interfacing between a first cigarette interfacing surface 1005 and a second cigarette first interfacing surface 1040. The second electronic cigarette is in attachment with the third electronic cigarette due to the interfacing between a second cigarette second interfacing surface 1045 and a third cigarette interfacing surface 1050. In this assembled configuration, the first mouthpiece, the second mouthpiece, and the third mouthpiece form a unitary mouthpiece, which a user can utilize to smoke from all three electronic cigarettes simultaneously.

Figure 10B:
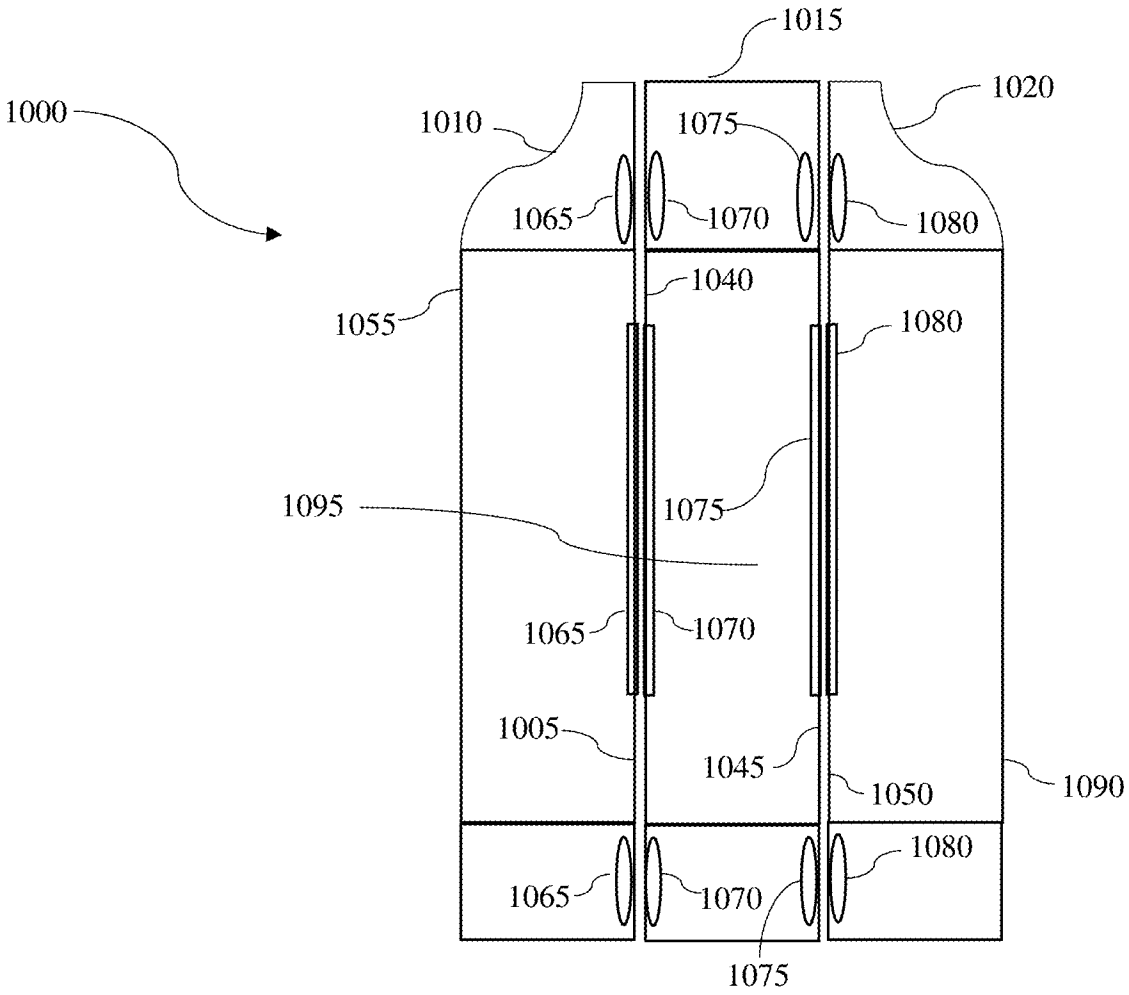
FIG. 10B is a diagram of a side perspective view of a fluid-based electronic cigarette system in an assembled configuration, with three attached electronic cigarettes, according to an example embodiment.

Referring to FIG. 10B, disclosed is a diagram of a side perspective view of a fluid-based electronic cigarette system 1000 in an assembled configuration, with three attached electronic cigarettes, according to an example embodiment. The system contains a first electronic cigarette 1055, a second cigarette 1095, and a third cigarette 1090. The first electronic cigarette contains a first cigarette interfacing surface 1005. The first cigarette contains at least one first cigarette magnet 1065. The at least one first cigarette magnet may be contained within the first cigarette interfacing surface, a first mouthpiece 1010, or within a first pod housing, according to example embodiments.

The second cigarette contains a second cigarette first interfacing surface 1040, a second mouthpiece 1015, and a second cigarette second interfacing surface 1045. The second cigarette contains at least one second cigarette first magnet 1070 and at least one second cigarette second magnet 1075. The at least one second cigarette first magnet may be contained within the second cigarette first interfacing surface, the second mouthpiece, or a second pod housing, according to example embodiments. The at least one second cigarette second magnet may be contained within the second cigarette second interfacing surface, the second mouthpiece, or the second pod housing, according to example embodiments.

The third cigarette 1090 contains a third cigarette interfacing surface 1050, a third mouthpiece 1020, and a third pod housing. The third cigarette contains at least one third cigarette magnet 1080. According to example embodiments, the at least one third cigarette magnet may be contained within the third cigarette interfacing surface, the third mouthpiece, or the third pod housing, according to example embodiments.

According to an example embodiment, the first cigarette is in attachment with the second cigarette because the at least one first cigarette magnet is configured to magnetically attach to the at least one second cigarette first magnet. In addition, in an example embodiment, the second cigarette is attached to the third cigarette because the at least one second cigarette second magnet is configured to magnetically attach to the at least one third cigarette magnet.

In an additional embodiment, with at least two electronic cigarettes, the system 1000 includes a first housing, a first magnet at least proximate to a first surface of the first housing; a second housing and a second magnet at least proximate to a second surface of the second housing; and a fully assembled configuration is formed when the second magnet magnetically mates with the first magnet such that the first surface is at least close to the second surface.

In a further embodiment, the first housing may contain a second first magnet, where the first magnet is at least proximate to a first side edge of the first housing and the first magnet has a first magnet pole proximate to an exterior of the first surface. Furthermore, the second first magnet is at least proximate to a second side edge of the first housing and the second first magnet has a second magnet pole proximate to the exterior of the first surface. The first magnet pole is different than the second magnetic pole.

Figure 11:
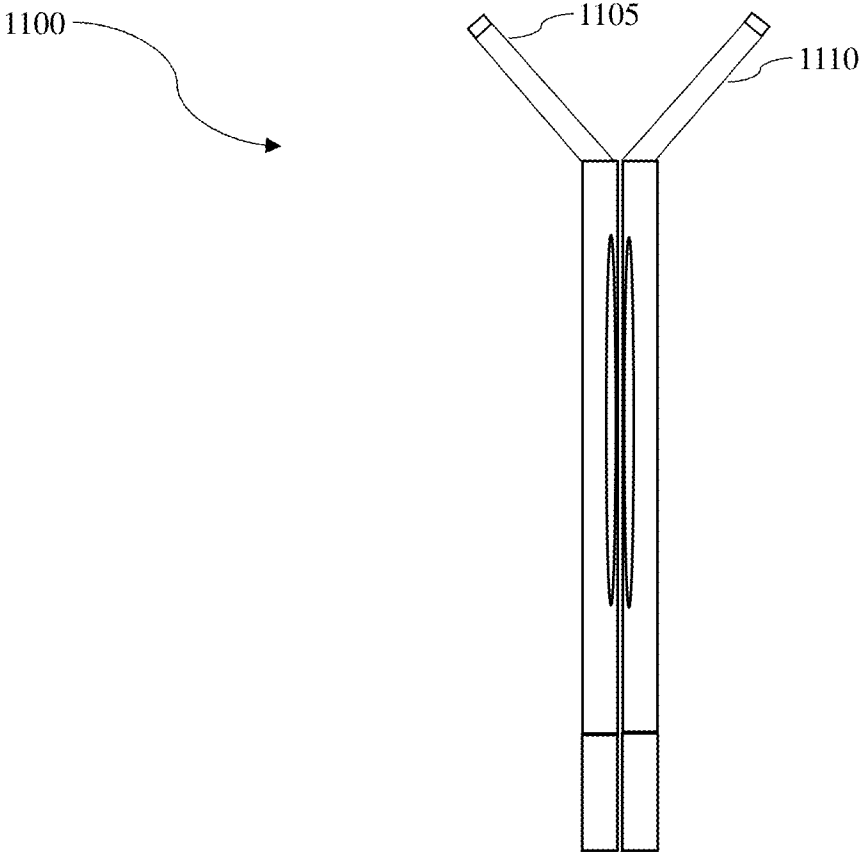
FIG. 11 is a diagram of a side perspective view of a fluid-based electronic cigarette system in an assembled configuration, with two attached electronic cigarettes, according to an example embodiment.

Referring to FIG. 11, disclosed is a diagram of a side perspective view of a fluid-based electronic cigarette system 1100 in an assembled configuration, with two attached electronic cigarettes, according to an example embodiment. The system contains a first mouthpiece 1105 and a second mouthpiece 1110. In the assembled configuration, the first mouthpiece and the second mouthpiece form a unitary mouthpiece. In this example embodiment, the first mouthpiece is configured to be inserted into one side of the user's mouth, and the second mouthpiece is configured to be inserted into the opposite side of the user's mouth. The unitary mouthpiece is formed in the fully assembled configuration when at least one of (a) the first mouthpiece is at least adjacent to a second mouthpiece, and (b) the first mouthpiece and second mouthpiece are configured such that the first mouthpiece and second mouthpiece can be simultaneously inserted into a user's mouth.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

I claim:

1. A fluid-based electronic cigarette system comprising:

a first electronic cigarette comprising at least a first housing and a first mouthpiece, wherein the first housing has a first interfacing surface;

a second electronic cigarette comprising at least a second housing and a second mouthpiece, wherein the second housing has a second interfacing surface;

an assembled configuration formed when the first interfacing surface removably connects to the second interfacing surface; and, a unitary mouthpiece formed by the first mouthpiece and the second mouthpiece in the assembled configuration.

2. The fluid-based electronic cigarette system of claim 1, wherein the fluid-based electronic cigarette system further comprises:

a. at least one first magnet at least proximate to the first interfacing surface;

b. at least one second magnet at least proximate to the second interfacing surface; and c. wherein the at least one first magnet magnetically mates with the least one second magnet to form the assembled configuration.

3. The fluid-based electronic cigarette system of claim 2, wherein the first interfacing surface and the second interfacing surface are substantially planar.

4. The fluid-based electronic cigarette system of claim 3, wherein the unitary mouthpiece is formed when at least one of (a) the first mouthpiece is at least adjacent to the second mouthpiece, and (b) the first mouthpiece and second mouthpiece are configured such that the first mouthpiece and second mouthpiece can be simultaneously inserted into a user's mouth.

5. The fluid-based electronic cigarette system of claim 4, wherein the first electronic cigarette comprises a first fluid disparate from a second fluid in the second electronic cigarette.

6. The fluid-based electronic cigarette system of claim 5, wherein the first electronic cigarette comprises a first e-fluid having a first flavor disparate from a second e-fluid in the second electronic cigarette having a second flavor.

7. The fluid-based electronic cigarette system of claim 6, wherein the first electronic cigarette comprises a first volume disparate from a second volume of the second electronic cigarette.

8. The fluid-based electronic cigarette system of claim 6, wherein the first electronic cigarette comprises a first volume equal to and disparate from a second volume of the second electronic cigarette.

9. The fluid-based electronic cigarette system of claim 8, wherein the first volume has a first maximum volume of 2 milliliters and the second volume has a second maximum volume of 2 milliliters.

10. The fluid-based electronic cigarette system of claim 1, wherein the first interfacing surface comprises a male track configured to removably mate with a female track on the second interfacing surface.

11. The fluid-based electronic cigarette system of claim 4, wherein the unitary mouthpiece has a transverse cross-section that is ovular.

12. The fluid-based electronic cigarette system of claim 4, wherein the first mouthpiece and each mouthpiece each have a transverse cross section, and wherein each transverse cross section has a first side that is asymmetrical to second side.

13. A fluid-based electronic cigarette comprising:

a housing having a first end, a second end and a side interfacing surface;

wherein the side interfacing surface is on an exterior of the housing and is disparate from the first end and second end; and, a magnet at least proximate to the side interfacing surface.

14. The fluid-based electronic cigarette of claim 13 further comprising a second magnet:

wherein the magnet is at least proximate to the side interfacing surface and to a first side edge of the side interfacing surface and wherein the magnet has a magnet pole proximate to the exterior of the side interfacing surface;

wherein the second magnet is at least proximate to the side interfacing surface and to a second side edge of the side interfacing surface and wherein the second magnet has a second magnet pole proximate to the exterior of the side interfacing surface; and, wherein the magnet pole is different than the second magnetic pole.

15. The fluid-based electronic cigarette of claim 14, wherein the housing comprises a second side interfacing surface.

16. The fluid-based electronic cigarette of claim 15, wherein the housing comprises at least a third magnet at least proximate to the second side interfacing surface.

17. A fluid-based electronic cigarette system comprising:

a first housing having a first housing first end and a first housing second end and a first magnet at least proximate to a first side surface of the first housing;

a second housing having a second housing first end and a second housing second end and a second magnet at least proximate to a second side surface of the second housing; and, a fully assembled configuration formed when the second magnet magnetically mates with the first magnet such that the first side surface is at least close to the second side surface.

18. The fluid-based electronic cigarette of claim 17, wherein the first housing further comprises a second first magnet:

wherein the first magnet is at least proximate to a first side edge of the first housing and wherein the first magnet has a first magnet pole proximate to an exterior of the first side surface;

wherein the second first magnet is at least proximate to a second side edge of the first housing and wherein the second first magnet has a second magnet pole proximate to the exterior of the first side surface; and, wherein the first magnet pole is different than the second magnetic pole.

19. The fluid-based electronic cigarette system of claim 17, wherein a unitary mouthpiece is formed in the fully assembled configuration when at least one of (a) a first mouthpiece is at least adjacent to a second mouthpiece, and (b) the first mouthpiece and second mouthpiece are configured such that the first mouthpiece and second mouthpiece can be simultaneously inserted into a user's mouth.

20. The fluid-based electronic cigarette system of claim 17, wherein the first housing defines a first volume disparate from a second volume of the second housing.

* * * * *